US010355373B2

(12) United States Patent
Iwasawa et al.

(10) Patent No.: US 10,355,373 B2
(45) Date of Patent: Jul. 16, 2019

(54) CRIMP TERMINAL AND WIRE WITH CRIMP TERMINAL

(71) Applicant: Yazaki Corporation, Tokyo (JP)

(72) Inventors: Hidehiko Iwasawa, Shizuoka (JP); Syunsuke Yaoita, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/700,853

(22) Filed: Sep. 11, 2017

(65) Prior Publication Data

US 2018/0076532 A1 Mar. 15, 2018

(30) Foreign Application Priority Data

Sep. 12, 2016 (JP) ..... 2016-177307

(51) Int. Cl.
*H01R 4/18* (2006.01)
*H01R 4/70* (2006.01)

(52) U.S. Cl.
CPC ..... *H01R 4/185* (2013.01); *H01R 4/70* (2013.01)

(58) Field of Classification Search
CPC ..... H01R 4/185; H01R 4/70
USPC ..... 439/877, 866, 851
See application file for complete search history.

(56) References Cited

U.S. PATENT DOCUMENTS 4,828,516 A * 5/1989 Shaffer ..... H01R 43/058 29/863
5,519,170 A * 5/1996 Nabeshima ..... H01R 13/5205 174/74 R
5,636,438 A * 6/1997 Takagishi ..... H01R 43/04 29/753
5,671,528 A * 9/1997 Endo ..... H01R 43/058 29/753

(Continued)

FOREIGN PATENT DOCUMENTS

JP 57-9172 U 1/1982
JP 2009-193879 A 8/2009

(Continued)

OTHER PUBLICATIONS

Japanese Office Action for the related Japanese Patent Application No. 2016-177307 dated Feb. 5, 2019.

(Continued)

*Primary Examiner* — Alexander Gilman
(74) *Attorney, Agent, or Firm* — Kenealy Vaidya LLP

(57) ABSTRACT

A crimp terminal included in a wire harness includes an electrical connecting portion, a conductor caulking portion, and a coat caulking portion. The conductor caulking portion includes a first base to which the electrical connecting portion is joined at one side in an axial direction and to which the coat caulking portion is joined at the other side, and a pair of first barrel pieces that extend from the first base and wrap the conductor of the wire between the first base and the pair of first barrel pieces and caulked. The pair of first barrel pieces include bell-mouth portions at end por- (Continued)

tions close to the coat caulking portion. The first base has a first protrusion at a position facing base ends of the bell-mouth portions across the conductor, having a recessed portion on the conductor side and protruding away from the conductor, and extending in a crossing direction.

4 Claims, 6 Drawing Sheets

(56) References Cited

U.S. PATENT DOCUMENTS 5,692,294 A * 12/1997 Casey ..... B25B 27/146 29/751
5,824,962 A * 10/1998 Katsuma ..... H01R 13/5205 174/135
6,997,746 B2 * 2/2006 Taylor ..... H01R 4/183 439/585
8,616,928 B2 * 12/2013 Uchiyama ..... H01R 4/184 439/877
9,484,640 B2 * 11/2016 Yamaji ..... H01R 4/62
9,502,785 B2 * 11/2016 Schmidt ..... H01R 4/183
9,755,327 B2 * 9/2017 Aoki ..... H01R 4/185
9,780,461 B2 * 10/2017 Yoshida ..... H01R 4/185
9,843,120 B2 * 12/2017 Matsushita ..... H01R 13/11
9,882,290 B2 * 1/2018 Shinohara ..... H01R 4/185
2013/0040511 A1 * 2/2013 Takashima ..... H01R 4/024 439/882
2013/0095708 A1 * 4/2013 Mitose ..... H01R 4/184 439/878
2016/0013567 A1 * 1/2016 Sakaguchi ..... H01R 4/185 439/877
2017/0005417 A1 * 1/2017 Aoki ..... H01R 4/62

FOREIGN PATENT DOCUMENTS

JP 2010-80193 A 4/2010
JP 2010-123282 A 6/2010
JP 2010-244889 A 10/2010
JP 2014-183023 A 9/2014
JP 2015-201269 A 11/2015
WO 2009/102074 A1 8/2009

OTHER PUBLICATIONS

Japanese Office Action for the related Japanese Patent Application No. 2016-177307 dated Oct. 23, 2018.
Japanese Office Action for the related Japanese Patent Application No. 2016-177307 dated Apr. 26, 2019.

* cited by examiner

CRIMP TERMINAL AND WIRE WITH CRIMP TERMINAL

CROSS-REFERENCE TO RELATED APPLICATION(S)

The present application claims priority to and incorporates by reference the entire contents of Japanese Patent Application No. 2016-177307 filed in Japan on Sep. 12, 2016.

BACKGROUND OF THE INVENTION

1. Field of the Invention

The present invention relates to a crimp terminal and a wire with a crimp terminal.

2. Description of the Related Art

A conventional crimp terminal included in a wire harness used in vehicles is disclosed in, for example, Japanese Patent Application Laid-open No. 2015-201269. This crimp terminal is provided with an electric wire connection section to be crimped to an electric wire. The electric wire connection section includes a conductor crimping section that crimps a conductor of the electric wire and a coat crimping section that crimps the electric wire from an outer circumference of a coat, which are successively disposed to each other.

To more suitably connect the crimp terminal disclosed in Japanese Patent Application Laid-open No. 2015-201269 to the electric wire, further improvement can be made with regard to the configuration of connecting the crimp terminal to the electric wire.

SUMMARY OF THE INVENTION

The present invention has been made in view of the foregoing, and it is an object of the present invention to provide a crimp terminal that can be more suitably connected to an electric wire and to provide a wire with a crimp terminal.

In order to achieve the above mentioned object, a crimp terminal according to one aspect of the present invention includes an electrical connecting portion configured to be electrically connected to a conductive member; a conductor caulking portion configured to be caulked onto a conductor of a wire; and a coat caulking portion configured to be caulked onto an insulating coat of the wire, wherein the conductor caulking portion includes a first base to which the electrical connecting portion is joined at one side of the first base in an axial direction and to which the coat caulking portion is joined at another side of the first base in the axial direction, and includes a pair of first barrel pieces that extend from both sides of the first base in a crossing direction that crosses the axial direction, the pair of first barrel pieces being configured to wrap the conductor between the first base and the pair of first barrel pieces and be caulked, the pair of first barrel pieces include a bell-mouth portion at an end portion of the pair of first barrel pieces close to the coat caulking portion, the bell-mouth portion extending to be distant from the conductor along the axial direction from a base end to a distal end of the bell-mouth portion, the distal end being close to the coat caulking portion, and the first base has a first protrusion disposed at a position facing the base end of the bell-mouth portion across the conductor, the first protrusion having a recessed portion on the conductor side and protruding away from the conductor, the first protrusion extending in the crossing direction.

According to another aspect of the present invention, in the crimp terminal, it is preferable that the coat caulking portion includes a second base to which the first base of the conductor caulking portion is joined at a side of the second base in the axial direction, and includes a pair of second barrel pieces that are separate from the pair of first barrel pieces and that extend from both sides of the second base in the crossing direction, the pair of second barrel pieces configured to wrap the insulating coat between the second base and the pair of second barrel pieces and be caulked, the first base has a second protrusion disposed at a position closer to the electrical connecting portion than the first protrusion in the axial direction, the second protrusion having a recessed portion on the conductor side and protruding away from the conductor, the second protrusion extending in the crossing direction, and the second base has a third protrusion having a recessed portion on the insulating coat side and protruding away from the insulating coat, the third protrusion extending in the crossing direction.

According to still another aspect of the present invention, in the crimp terminal, it is preferable that the conductor caulking portion has a plurality of serrations on the conductor side, the serrations being recessed on the conductor side and being flat on a side opposite to the conductor, and the first protrusion, the second protrusion, and the third protrusion are separate from the serrations.

In order to achieve the above mentioned object, a wire with a crimp terminal according to one aspect of the present invention includes a wire; and the crimp terminal being caulked onto the wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 2:
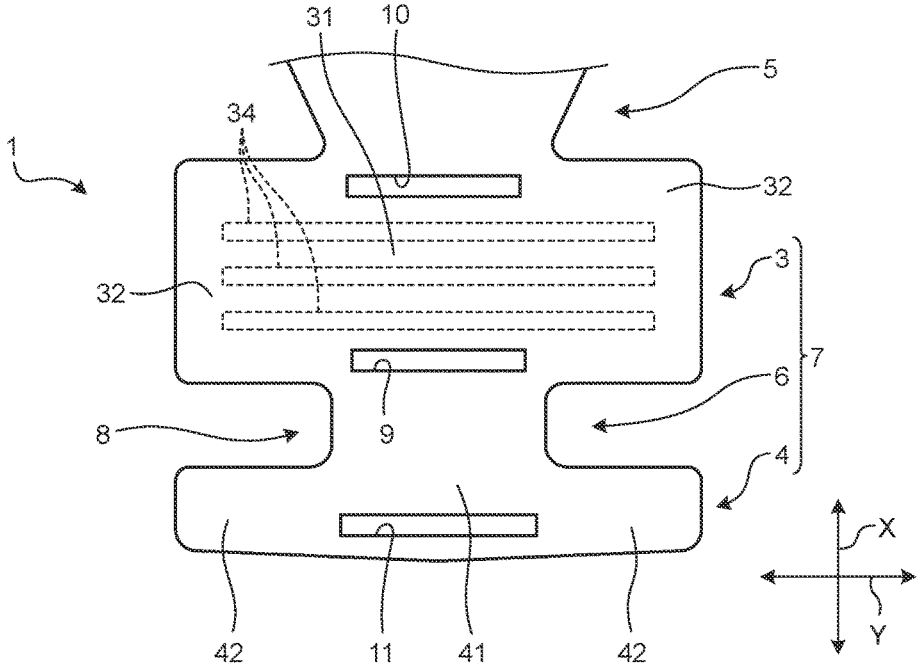
FIG. 2 is a partial plan view illustrating a development of the crimp terminal according to the embodiment.

The following fully describes an embodiment of the present invention with reference to the accompanying drawings. The embodiment is not intended to limit the scope of the present invention. Components in the following embodiment include components that can be easily replaced by the person skilled in the art, or components that are substantially the same. FIG. 2 is a partial plan view illustrating a development of a crimp terminal according to the embodiment. In other words, FIG. 2 is a partial plan view illustrating a development of a metal sheet to be pressed to form the crimp terminal. FIG. 2 is also a plan view illustrating an outer surface (a surface away from a conductor) of the crimp terminal.

Embodiment

Figure 1:
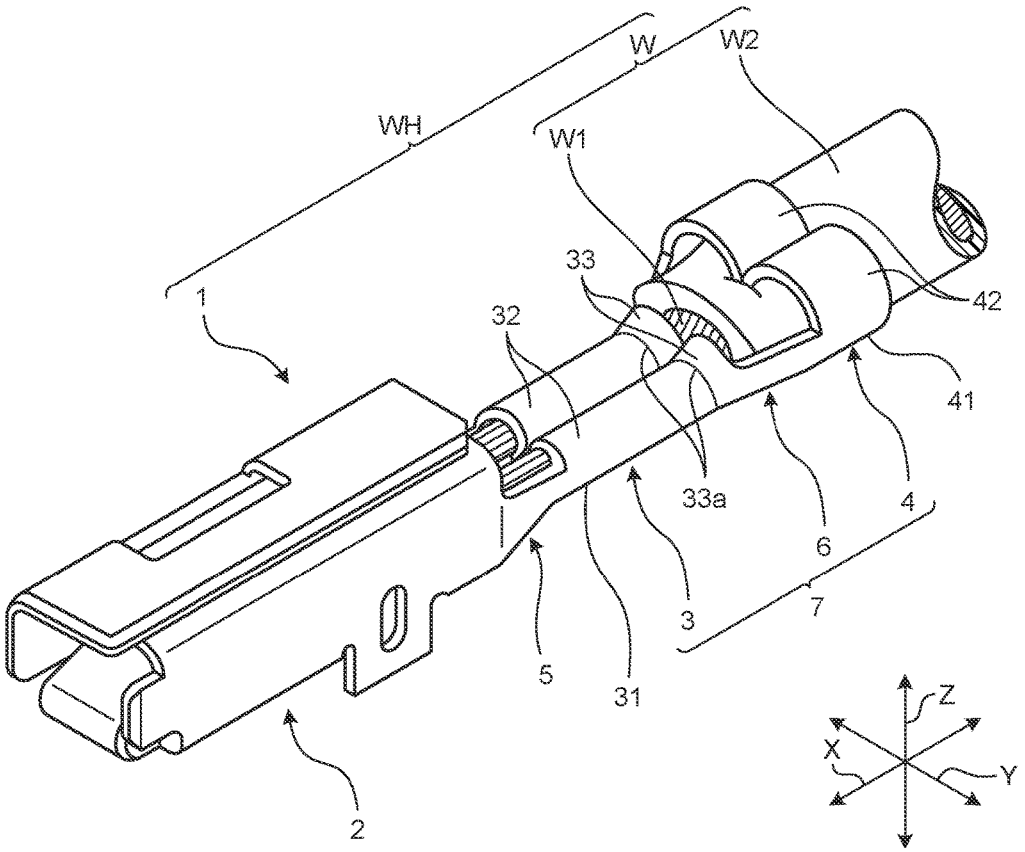
FIG. 1 is a partial perspective view illustrating a general configuration of a crimp terminal according to an embodiment.
Figure 3:
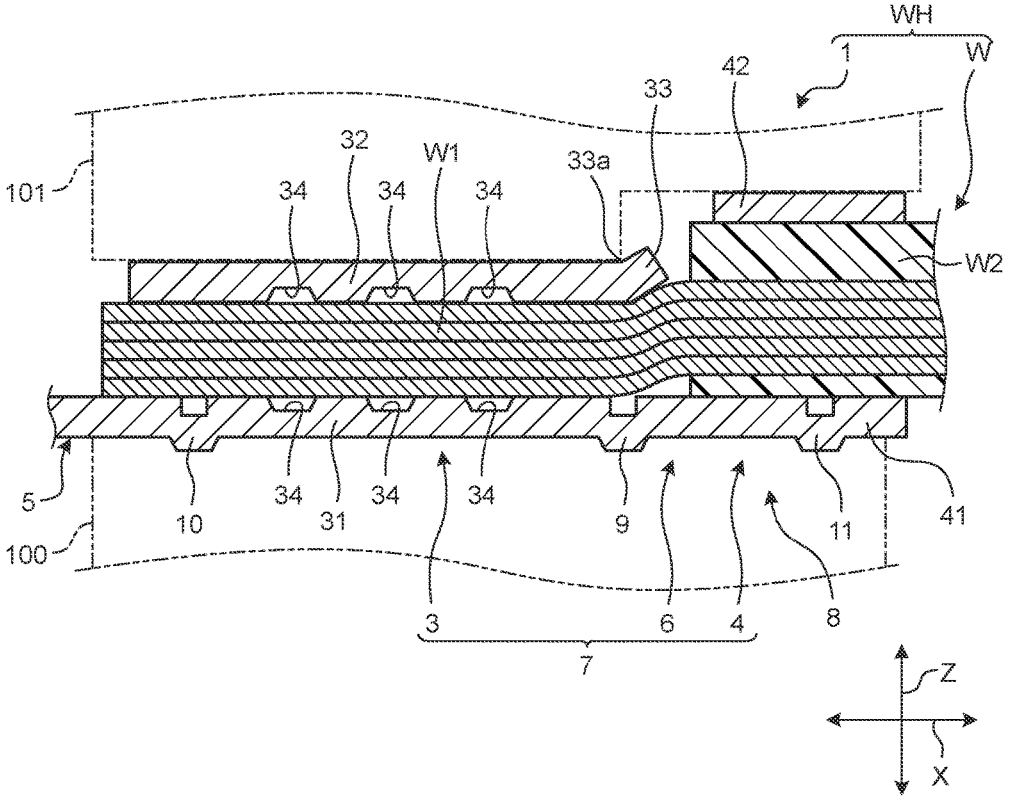
FIG. 3 is a partial sectional view schematically illustrating a general configuration of the crimp terminal according to the embodiment.

A crimp terminal 1 according to the embodiment illustrated in FIGS. 1 to 3 is a terminal fitting included in, for example, a wire harness WH used in vehicles. The wire harness WH is an assembly of a plurality of wires W bundled together for transmitting signals or electrical power, and is used for, for example, connecting devices installed in a vehicle. The wires W are connected at once to a device by, for example, a connector. The wire harness WH includes a wire W and the crimp terminal 1 provided to an end of the wire W. The wire W includes, for example, a linear conductor W1 having conductivity and an insulating coat W2 that covers the outside of the conductor W1 and has an insulating property. The conductor W1 according to the present embodiment is a core wire composed of a plurality of element wires bundled together and made of a conductive metal such as copper, copper alloy, aluminum, or aluminum alloy. The conductor W1 may be a stranded core wire composed of a plurality of element wires that are stranded together. The insulating coat W2 is a wire coat that covers the outer circumference of the conductor W1. For example, the insulating coat W2 is formed by extrusion molding of an insulating resin material, such as polypropylene (PP), polyvinyl chloride (PVC), or cross-linked polyethylene (PE). The resin material is selected as appropriate in terms of abrasion resistance, chemical resistance, and thermal resistance, for example. The insulating coat W2 of the wire W at at least an end of the conductor W1 is stripped, and the end of the conductor W1 is exposed from the insulating coat W2. The crimp terminal 1 is provided to the end of the exposed conductor W1. The wire W has substantially the same diameter along a extending direction in which the wire W linearly extends. The cross section (cross section in a direction crossing the extending direction) of the conductor W1 has a substantially circular shape, and the cross section of the insulating coat W2 has a substantially annular shape. The cross section of the entire wire W has a substantially circular shape. The wire harness WH may further include, for example, a grommet, a protector, and a fixture. The following describes in detail a configuration of the crimp terminal 1 with reference to the accompanying drawings.

In the description below, first, second, and third directions that cross each other are referred to as an "axial direction X", a "width direction Y", and a "height direction Z", respectively. The axial direction X, the width direction Y, and the height direction Z are substantially orthogonal to each other. Typically, the axial direction X corresponds to the extending direction of the wire W to which the crimp terminal 1 is provided, and corresponds to the direction in which an electrical connecting portion 2, a conductor caulking portion 3, and a coat caulking portion 4 of the crimp terminal 1 are arranged. The width direction Y and the height direction Z correspond to directions that cross the axial direction X. The directions referred to in the description below indicate directions with the components being assembled each other unless otherwise specified.

The crimp terminal 1 includes the electrical connecting portion 2, the conductor caulking portion 3, the coat caulking portion 4, a first joining portion 5, and a second joining portion 6 that are integrally formed and made of a conductive metal such as copper, copper alloy, aluminum, or aluminum alloy. For example, the crimp terminal 1 is formed from a metal sheet that is die cut into a shape including portions corresponding to, for example, the electrical connecting portion 2, the conductor caulking portion 3, the coat caulking portion 4, the first joining portion 5, and the second joining portion 6. The metal sheet is pressed and bent, so that the portions are integrally and three-dimensionally formed. In the crimp terminal 1, the electrical connecting portion 2, the first joining portion 5, the conductor caulking portion 3, the second joining portion 6, and the coat caulking portion 4 are arranged and joined to each other in this order along the axial direction X from one end to the other end of the crimp terminal 1. In other words, the first joining portion 5 joins the electrical connecting portion 2 with the conductor caulking portion 3. The second joining portion 6 joins the conductor caulking portion 3 with the coat caulking portion 4. The conductor caulking portion 3 is joined to the electrical connecting portion 2 via the first joining portion 5 and to the coat caulking portion 4 via the second joining portion 6 at both sides in the axial direction X with a gap therebetween. The conductor caulking portion 3, the coat caulking portion 4, and the second joining portion 6 configure a wire connecting portion 7 that electrically connects the crimp terminal 1 to an end of the wire W. The crimp terminal 1 is conductively connected to the wire W such that the electrical connecting portion 2 is electrically connected to the wire connecting portion 7 via the first joining portion 5, and the electrical connecting portion 2 is electrically connected to the conductor W1 of the wire W via the wire connecting portion 7.

The electrical connecting portion 2 is electrically connected to a conductive member. The conductive member according to the present embodiment is, for example, a counterpart terminal (not illustrated). In other words, the electrical connecting portion 2 according to the present embodiment is configured as a terminal connecting portion to be electrically connected to the counterpart terminal. The electrical connecting portion 2 may have a male-ended terminal or a female-ended terminal. The electrical connecting portion 2 according to the present embodiment illustrated in FIG. 1 has a female-ended terminal, and is electrically connected to a counterpart male-ended terminal. The conductive member may not be a counterpart terminal, and may be, for example, various types of conductive members such as a grounding member. The electrical connecting portion 2 may not configure a terminal connecting portion to be electrically connected to a counterpart terminal, and may have what is called a ring terminal (LA terminal) to be fastened onto, for example, a grounding member.

The conductor caulking portion 3 is caulked and crimped onto the conductor W1 of the wire W, and is electrically connected to the conductor W1. The conductor caulking portion 3 includes a first base 31 as a base of the conductor caulking portion, and a pair of first barrel pieces 32 as barrel pieces of the conductor caulking portion. The first base 31 is a plate-like portion on which an end portion of the conductor W1 of the wire W is placed. The first base 31 is joined to the electrical connecting portion 2 via the first joining portion 5 at a side in the axial direction X, and is joined to the coat caulking portion 4 via the second joining portion 6 at the other side in the axial direction X. The first base 31 is joined to a second base 41 of the coat caulking portion 4 to be described later via the second joining portion 6. The first joining portion 5, the first base 31, the second joining portion 6, and the second base 41 are successively joined to configure a bottom plate 8 that extends in the axial direction X. The pair of first barrel pieces 32 are formed in a band-like shape extending from both sides of the first base 31 in the width direction Y, and wrap the conductor W1 between the first base 31 and the pair of first barrel pieces 32, and caulked and crimped. The pair of first barrel pieces 32 are separate from the electrical connecting portion 2 and the coat caulking portion 4 in the axial direction X with a gap therebetween. Before caulking, the pair of first barrel pieces 32, which will be caulked onto the conductor W1 by an anvil 100 and a crimper 101 to be described later, are bent relative to the first base 31 and form a substantial U-shape together with the first base 31. Each of the pair of first barrel pieces 32 according to the present embodiment has substantially the same length from the base end close to the first base 31 to the distal end so as not to be overlapped when the pair of first barrel pieces 32 are caulked onto the conductor W1. The pair of first barrel pieces 32 have bell-mouth portions 33 at their end portions close to the coat caulking portion 4. The bell-mouth portions 33 are provided to prevent damage to the conductor W1 that may be caused by edges of the pair of first barrel pieces 32 on an inner surface when the pair of first barrel pieces 32 are wrapped around the conductor W1 on the first base 31 and caulked. The bell-mouth portions 33 extend to be distant from the conductor W1 along the axial direction X from base ends 33*a* to distal ends close to the coat caulking portion 4. In other words, the bell-mouth portions 33 extend outward at an angle to be distant from the outer circumference of the conductor W1 along the axial direction X from the base ends 33*a* to the distal ends close to the coat caulking portion 4. The conductor caulking portion 3 includes a plurality of serrations 34. Typically, the serrations 34 are shallow linear grooves formed by, for example, pressing. More specifically, a plurality of depressions of the serrations 34 are formed on a surface close to the conductor W1, that is, formed on an inner placing surface on which the conductor W1 is placed, whereas the other surface (outer surface) away from the conductor W1 is flat. The serrations 34 are linearly formed in the width direction Y from one first barrel piece 32 through the first base 31 to the other first barrel piece 32. In the present embodiment, three serrations 34 spaced apart in the axial direction X are provided.

The coat caulking portion 4 is caulked and crimped onto the insulating coat W2 of the wire W. The coat caulking portion 4 includes the second base 41 as a base of the coat caulking portion, and a pair of second barrel pieces 42 as barrel pieces of the coat caulking portion. The second base 41 is a plate-like portion on which an end portion of the insulating coat W2 of the wire W is placed. As described above, the second base 41 is joined to the first base 31 of the conductor caulking portion 3 via the second joining portion 6 at one side in the axial direction X. As described above, the second base 41 and the first joining portion 5, the first base 31, and the second joining portion 6 configure the bottom plate 8. The pair of second barrel pieces 42 are formed in a band-like shape extending from both sides of the second base 41 in the width direction Y, and wrap the insulating coat W2 between the second base 41 and the pair of second barrel pieces 42, and caulked and crimped. The pair of second barrel pieces 42 are separate from the conductor caulking portion 3 in the axial direction X with a gap therebetween, that is, the pair of second barrel pieces 42 are separate from the pair of first barrel pieces 32 and are formed as distinct portions. Before caulking, the pair of second barrel pieces 42, which will be caulked onto the insulating coat W2 by the anvil 100 and the crimper 101 to be described later, are bent relative to the second base 41 and form a substantial U-shape together with the second base 41. Each of the pair of second barrel pieces 42 according to the present embodiment has substantially the same length from the base end close to the second base 41 to the distal end so as not to be overlapped when the pair of second barrel pieces 42 are caulked onto the insulating coat W2.

In the crimp terminal 1 according to the present embodiment as configured above, the first base 31 of the conductor caulking portion 3 further includes a first protrusion 9. The first protrusion 9 is disposed at a position facing the base ends 33*a* of the bell-mouth portions 33 across the conductor W1 in the height direction Z on the first base 31. The first protrusion 9 has a recessed portion close to the conductor W1, and protrudes away from the conductor W1. In other words, the first protrusion 9 has a recessed portion on a surface close to the conductor W1, that is, on an inner placing surface on which the conductor W1 is placed, and has a raised portion on the other surface (outer surface) away from the conductor W1. The first protrusion 9 linearly extends in the width direction Y.

In the crimp terminal 1 according to the present embodiment, the first base 31 of the conductor caulking portion 3 further includes a second protrusion 10, and the second base 41 of the coat caulking portion 4 includes a third protrusion 11. The second protrusion 10 is disposed on the first base 31 at a position closer to the electrical connecting portion 2 than the first protrusion 9, that is, disposed at an end of the first base 31 close to the first joining portion 5 in the axial direction X. The second protrusion 10 has a recessed portion close to the conductor W1, and protrudes away from the conductor W1 in the same manner as the first protrusion 9. In other words, the second protrusion 10 has a recessed portion on a surface close to the conductor W1, that is, on an inner placing surface on which the conductor W1 is placed, and has a raised portion on the other surface (outer surface) away from the conductor W1. The second protrusion 10 linearly extends in the width direction Y. The third protrusion 11 is disposed approximately in the middle of the second base 41 in the axial direction X. The third protrusion 11 has a recessed portion close to the insulating coat W2 and protrudes away from the insulating coat W2 in the same manner as the first protrusion 9 and the second protrusion 10. In other words, the third protrusion 11 has a recessed portion on a surface close to the insulating coat W2, that is, on an inner placing surface on which the insulating coat W2 is placed and has a raised portion on the other surface (outer surface) away from the insulating coat W2. The third protrusion 11 linearly extends in the width direction Y. The first protrusion 9 and the second protrusion 10 are disposed with the serrations 34 therebetween in the axial direction X. The second protrusion 10 and the third protrusion 11 are disposed with the second joining portion 6 described above therebetween in the axial direction X. The first protrusion 9, the second protrusion 10, and the third protrusion 11 are separate from the serrations 34 and are substantially parallel to each other.

The conductor caulking portion 3 and the coat caulking portion 4 are deformed by using, for example, a die assembly called the anvil 100 as a lower die and the crimper 101 as an upper die as illustrated in FIG. 3, and the crimp terminal 1 configured above is caulked and crimped onto the wire W. In other words, the first base 31 of the conductor caulking portion 3 and the second base 41 of the coat caulking portion 4 are placed on a placing surface of the anvil 100, and the conductor W1 of the wire W is placed on the first base 31 to be located between the pair of first barrel pieces 32, and the insulating coat W2 of the wire W is placed on the second base 41 to be located between the pair of second barrel pieces 42, to caulk and crimp the crimp terminal 1. The crimper 101 facing the anvil 100 from above in the height direction Z relatively approaches the anvil 100 along the height direction Z with the pair of first barrel pieces 32 and the pair of second barrel pieces 42 of the crimp terminal 1 being gradually pressed, bent, and deformed inward toward the first base 31 and the second base 41, respectively. By using the anvil 100 and the crimper 101, the conductor caulking portion 3 of the crimp terminal 1 is crimped onto the conductor W1 with the pair of first barrel pieces 32 and the first base 31 being wrapped around the conductor W1 and caulked, and the coat caulking portion 4 of the crimp terminal 1 is crimped onto the insulating coat W2 with the pair of second barrel pieces 42 and the second base 41 being wrapped around the insulating coat W2 and caulked. In this crimping process, the edges of the first protrusion 9, the second protrusion 10, and the third protrusion 11 on the outer surface formed along the width direction Y that crosses the axial direction X abut the placing surface of the anvil 100, thereby increasing friction between the placing surface of the anvil 100 and the crimp terminal 1. This friction can prevent the crimp terminal 1 from expanding in the axial direction X when the crimp terminal 1 is pressed and caulked by the anvil 100 and the crimper 101.

When the anvil 100 and the crimper 101 press and caulk the crimp terminal 1, portions corresponding to the bell-mouth portions 33 are left unpressed and caulked as unpressed portions, thereby forming the bell-mouth portions 33. The bell-mouth portions 33 of the crimp terminal 1 can prevent damage to the conductor W1 that may be caused by the edges of the pair of first barrel pieces 32 at inner end portions when the pair of first barrel pieces 32 are wrapped around the conductor W1 on the first base 31 and caulked. At this point, in the crimp terminal 1, the first protrusion 9, which is disposed at a position facing the base ends 33*a* of the bell-mouth portions 33 across the conductor W1, has a recessed portion on the conductor W1 side. The recessed portion of the first protrusion 9 serves as a relief that accommodates the conductor W1 when the pair of first barrel pieces 32 are wrapped around the conductor W1 on the first base 31 and caulked. With this configuration, the crimp terminal 1 can reduce stresses on a region of the conductor W1 near the base ends 33*a* of the bell-mouth portions 33, the region to which more stresses are likely to be applied than to the other regions. Thus, the crimp terminal 1 can more fully prevent damage to the conductor W1.

In the crimp terminal 1, the edges of the serrations 34 formed on the surface of the conductor caulking portion 3 close to the conductor W1 and the edges of the first protrusion 9 and the second protrusion 10 formed on the surface of the conductor caulking portion 3 close to the conductor W1 increase the contact area between the conductor caulking portion 3 and the conductor W1, thereby increasing contact stability, crimping strength, and bond stability.

In the crimp terminal 1 and the wire harness WH described above, the wire W and the crimp terminal 1 are successfully connected via the conductor caulking portion 3 that is caulked onto the conductor W1 of the wire W and via the coat caulking portion 4 that is caulked onto the insulating coat W2 of the wire W, and in this state, the electrical connecting portion 2 is electrically connected to a conductive member. In the crimp terminal 1 and the wire harness WH, the bell-mouth portions 33 are provided to the pair of first barrel pieces 32 that constitute the conductor caulking portion 3 and the first protrusion 9 is provided to the first base 31 that constitutes the conductor caulking portion 3, and thus the crimp terminal 1 can be suitably connected to the wire W. In other words, in the crimp terminal 1 and the wire harness WH, the bell-mouth portions 33 are provided to prevent damage to the conductor W1, and the first protrusion 9 is provided at a position facing the base ends 33*a* of the bell-mouth portions 33 to be also used as a region that performs at least three functions indicated in the following (1), (2), and (3). With this configuration, the crimp terminal 1 can be suitably connected to the wire W.

(1) Conductor damage prevention function for preventing damage to the conductor W1 by reducing stresses on a region of the conductor W1 near the base ends 33*a* of the bell-mouth portions 33.

(2) Serration function for increasing contact stability and bond stability between the conductor caulking portion 3 and the conductor W1.

(3) Terminal expansion prevention function for preventing the crimp terminal 1 from expanding in the axial direction X by increasing friction with the placing surface of the anvil 100.

In addition to the first protrusion 9, the crimp terminal 1 and the wire harness WH described above include the second protrusion 10 and the third protrusion 11 that abut the placing surface of the anvil 100 as well as the first protrusion 9. This configuration can further increase friction with the placing surface of the anvil 100, thereby more fully preventing expansion of the crimp terminal 1.

The crimp terminal 1 and the wire harness WH described above include the serrations 34 that can increase contact stability and bond stability between the conductor caulking portion 3 and the conductor W1. Furthermore, the first protrusion 9, the second protrusion 10, and the third protrusion 11 that are provided separately from the serrations 34 can prevent expansion of the crimp terminal 1 as described above.

The crimp terminal according to the embodiment above is not intended to limit the scope of the present invention, and various modifications can be made within the scope of the invention that is set forth in the following claims.

The pair of first barrel pieces 32 and the pair of second barrel pieces 42 described above may be configured to overlap each other when caulked onto the conductor W1, or the length of one of the pair of barrel pieces from the base end close to the first base 31 or the second base 41 to the distal end may be longer than the length of the other barrel piece.

The conductor caulking portion 3 described above may include second bell-mouth portions at end portions opposite to the bell-mouth portions 33 in the axial direction X. The serrations 34 described above linearly extend in the width direction Y, but are not limited to this. The serrations 34 may have other shapes, such as a substantially circular shape, substantially annular shape, substantially oval shape, substantially elongated circular shape, or substantially wavy line.

The crimp terminal 1 described above does not necessarily include all of the three protrusions that are the first protrusion 9, the second protrusion 10, and the third protrusion 11, and may include at least the first protrusion 9.

Figure 4:
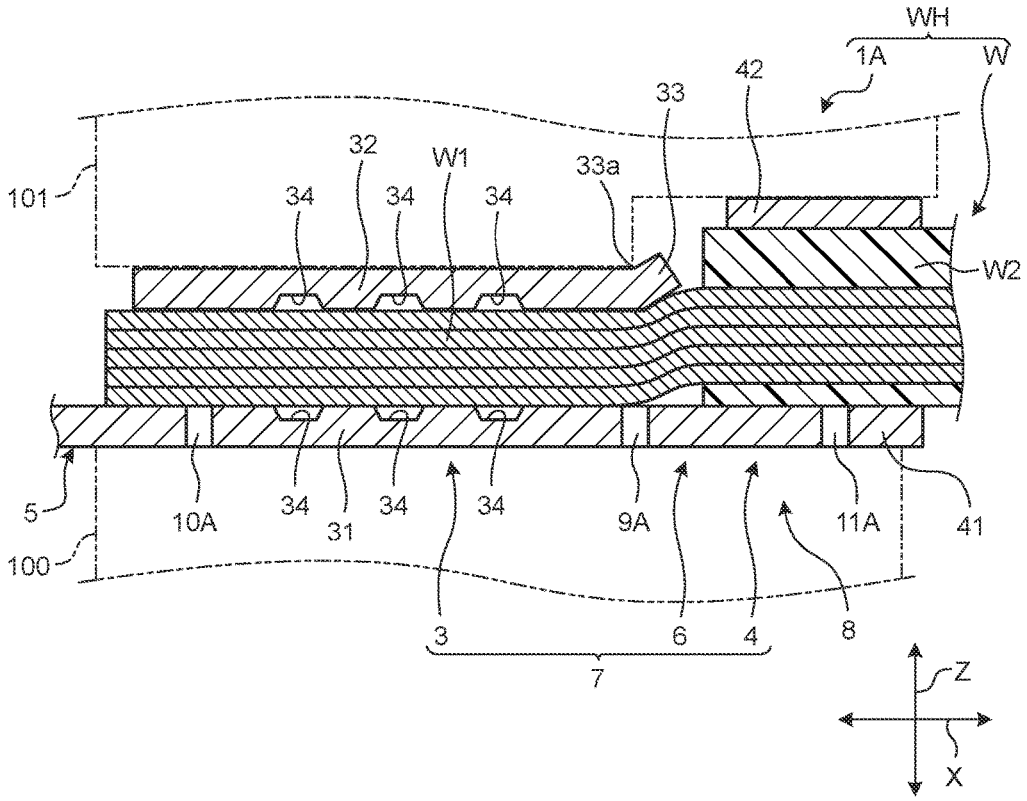
FIG. 4 is a partial sectional view schematically illustrating a general configuration of a crimp terminal according to a reference example.
Figure 5:
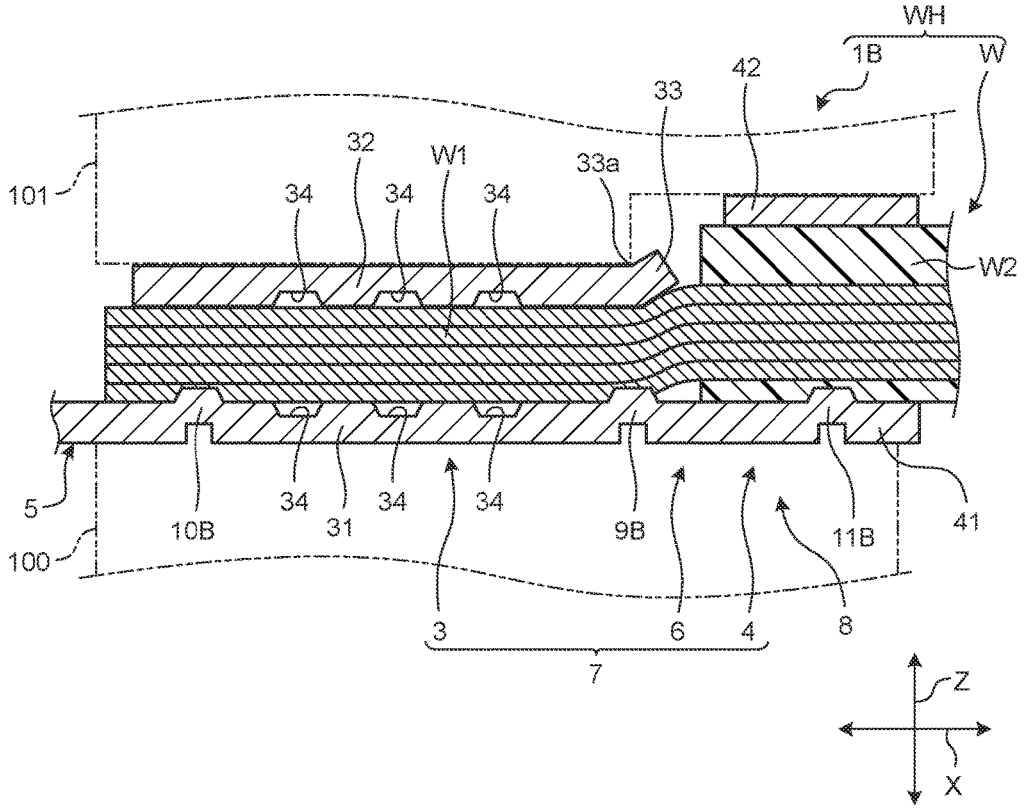
FIG. 5 is a partial sectional view schematically illustrating a general configuration of a crimp terminal according to another reference example.

To increase friction with the placing surface of the anvil 100 and prevent the crimp terminal from expanding in the axial direction X, a crimp terminal 1A according to a reference example illustrated in FIG. 4 includes, for example, a first through-hole 9A, a second through-hole 10A, and a third through-hole 11A instead of including the first protrusion 9, the second protrusion 10, and the third protrusion 11. The first through-hole 9A and the second through-hole 10A are formed through the first base 31 in the height direction Z, and the third through-hole 11A is formed through the second base 41 in the height direction Z. The first through-hole 9A, the second through-hole 10A, and the third through-hole 11A linearly extend in the width direction Y. A crimp terminal 1B according to another reference example illustrated in FIG. 5 includes, for example, a first recess 9B, a second recess 10B, and a third recess 11B instead of including the first protrusion 9, the second protrusion 10, and the third protrusion 11. The first recess 9B and the second recess 10B are recessed on a surface away from the conductor W1 and each have a raised portion on a surface close to the conductor W1. The third recess 11B is recessed on a surface away from the insulating coat W2 and has a raised portion on a surface close to the insulating coat W2. The first recess 9B, the second recess 10B, and the third recess 11B linearly extend in the width direction Y. The edges of the first through-hole 9A, the second through-hole 10A, the third through-hole 11A, the first recess 9B, the second recess 10B, and the third recess 11B increase friction with the placing surface of the anvil 100, thereby preventing the crimp terminals 1A and 1B from expanding in the axial direction X.

The anvil 100 described above, for example, may have a rough placing surface on which microscopic roughness is formed to further increase friction between the placing surface and the crimp terminal 1. This configuration can more fully prevent the crimp terminal from expanding in the axial direction X.

Figure 6:
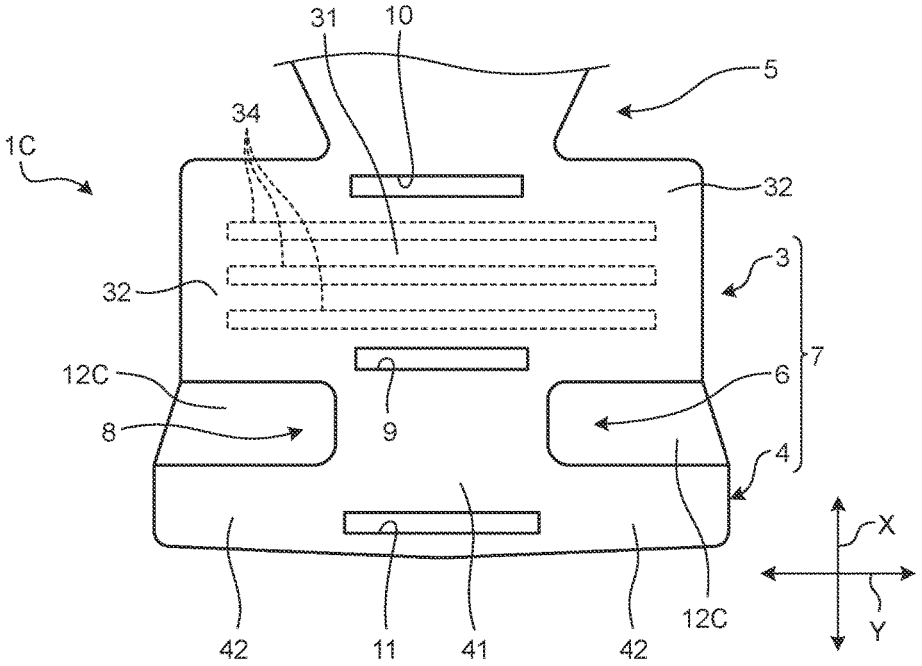
FIG. 6 is a partial plan view illustrating a development of a crimp terminal according to still another reference example.

A crimp terminal 1C according to still another reference example illustrated in FIG. 6 includes what is called integrated barrel type terminal in which one of the pair of first barrel pieces 32 and one of the pair of second barrel pieces 42 are integrated via a joining portion 12C and the other one of the pair of first barrel pieces 32 and the other one of the pair of second barrel pieces 42 are integrated via another joining portion 12C. Providing the first protrusion 9, the second protrusion 10, and the third protrusion 11 to the crimp terminal 1C, which includes such integrated barrel type terminal, can increase friction with the placing surface of the anvil 100, thereby preventing the crimp terminal 1C from expanding in the axial direction X.

The crimp terminal according to the embodiment is successfully connected to the wire via the conductor caulking portion that is caulked onto the conductor of the wire and via the coat caulking portion that is caulked onto the insulating coat of the wire. With this configuration, the electrical connecting portion is electrically connected to a conductive member. The pair of first barrel pieces that constitute the conductor caulking portion are provided with the bell-mouth portions, and the first base that constitutes the conductor caulking portion is provided with the first protrusion. Providing the bell-mouth portions and the first protrusion enables the crimp terminal to be suitably connected to the wire.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal comprising:

an electrical connecting portion configured to be electrically connected to a conductive member;

a conductor caulking portion configured to be caulked onto a conductor of a wire; and a coat caulking portion configured to be caulked onto an insulating coat of the wire, wherein the conductor caulking portion includes a first base to which the electrical connecting portion is joined at one side of the first base in an axial direction and to which the coat caulking portion is joined at another side of the first base in the axial direction, and includes a pair of first barrel pieces that extend from both sides of the first base in a crossing direction that crosses the axial direction, the pair of first barrel pieces being configured to wrap the conductor between the first base and the pair of first barrel pieces and be caulked, the pair of first barrel pieces include a bell-mouth portion at an end portion of the pair of first barrel pieces close to the coat caulking portion, the bell-mouth portion extending to be distant from the conductor along the axial direction from a base end to a distal end of the bell-mouth portion, the distal end being close to the coat caulking portion, and the first base has a first protrusion disposed at a position facing the base end of the bell-mouth portion across the conductor, the first protrusion having a recessed portion on the conductor side and protruding away from the conductor, the first protrusion extending in the crossing direction, and the first protrusion has a length in the crossing direction that is larger than a length in the axial direction.

2. The crimp terminal according to claim 1, wherein the coat caulking portion includes a second base to which the first base of the conductor caulking portion is joined at a side of the second base in the axial direction, and includes a pair of second barrel pieces that are separate from the pair of first barrel pieces and that extend from both sides of the second base in the crossing direction, the pair of second barrel pieces configured to wrap the insulating coat between the second base and the pair of second barrel pieces and be caulked, the first base has a second protrusion disposed at a position closer to the electrical connecting portion than the first protrusion in the axial direction, the second protrusion having a recessed portion on the conductor side and protruding away from the conductor, the second protrusion extending in the crossing direction, and the second base has a third protrusion having a recessed portion on the insulating coat side and protruding away from the insulating coat, the third protrusion extending in the crossing direction.

3. The crimp terminal according to claim 2, wherein the conductor caulking portion has a plurality of serrations on the conductor side, the serrations being recessed on the conductor side and being flat on a side opposite to the conductor, and the first protrusion, the second protrusion, and the third protrusion are separate from the serrations.

4. A wire with a crimp terminal comprising:

a wire; and the crimp terminal according to claim 1, the crimp terminal being caulked onto the wire.

* * * * *